US009103185B2

(12) United States Patent
Biddick et al.

(10) Patent No.: US 9,103,185 B2
(45) Date of Patent: Aug. 11, 2015

(54) VALVE WITH REMOVABLE COMPONENT

(75) Inventors: David James Biddick, Missouri City, TX (US); Paul G. Goughnour, Singapore (SG); Geoffrey Pinard, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 679 days.

(21) Appl. No.: 13/290,348

(22) Filed: Nov. 7, 2011

(65) Prior Publication Data

US 2012/0205114 A1 Aug. 16, 2012

Related U.S. Application Data

(60) Provisional application No. 61/441,299, filed on Feb. 10, 2011.

(51) Int. Cl.
*E21B 34/10* (2006.01)
*E21B 34/00* (2006.01)

(52) U.S. Cl.
CPC ..... *E21B 34/10* (2013.01); *E21B 2034/005* (2013.01); *Y10T 29/494* (2015.01); *Y10T 29/49412* (2015.01); *Y10T 29/49817* (2015.01); *Y10T 29/49947* (2015.01)

(58) Field of Classification Search
CPC ... E21B 34/10; E21B 2034/005; E21B 34/06; B23P 11/00; B23P 15/00; Y10T 29/49817; Y10T 29/49412; Y10T 29/49947; Y10T 29/494
USPC ..... 166/319, 316, 332.8, 334.1, 323, 321
See application file for complete search history.

(56) References Cited

U.S. PATENT DOCUMENTS

| | | | | |
|---|---|---|---|---|
| 3,002,526 | A | 10/1961 | Terral | |
| 4,134,455 | A | 1/1979 | Read | |
| 4,669,547 | A * | 6/1987 | Pringle | 166/321 |
| 5,029,646 | A | 7/1991 | Blizzard, Jr. | |
| 5,368,108 | A | 11/1994 | Aldred et al. | |
| 5,564,675 | A | 10/1996 | Hill, Jr. et al. | |
| 6,315,047 | B1 | 11/2001 | Deaton et al. | |
| 7,699,108 | B2 | 4/2010 | Bane et al. | |
| 2009/0242206 | A1 | 10/2009 | Goughnour et al. | |

FOREIGN PATENT DOCUMENTS

| | | | |
|---|---|---|---|
| EP | 0376930 | A1 | 7/1990 |
| GB | 1209358 | A | 10/1970 |
| WO | 9414086 | A1 | 6/1994 |

OTHER PUBLICATIONS

GB Search Report to UK Patent Application No. GB1201267.0 dated Apr. 11, 2012.

* cited by examiner

*Primary Examiner* — Yong-Suk (Philip) Ro
(74) *Attorney, Agent, or Firm* — David J. Groesbeck; Brandon Clark

(57) ABSTRACT

A technique facilitates prolonging the useful life of a subsurface valve without requiring replacement of the entire hydraulic chamber housing of the subsurface valve. A removable piston tube is provided and may be inserted into a valve housing of a subsurface valve. The removable piston tube is removably secured within a piston passage in the valve housing via a fastening mechanism. If necessary, the removable piston tube can be removed and replaced without requiring replacement of the overall housing.

10 Claims, 9 Drawing Sheets

VALVE WITH REMOVABLE COMPONENT

CROSS-REFERENCE TO RELATED APPLICATION

The present document is based on and claims priority to U.S. Provisional Application Ser. No. 61/441,299 filed Feb. 10, 2011, which is incorporated herein by reference.

BACKGROUND

Many types of subsurface valves are used in a variety of well related applications. For example, subsurface safety valves are used to control flow along a completion located in a wellbore. Existing subsurface safety valves are actuated by a piston that slides along a bore within a hydraulic chamber housing of the subsurface safety valve. To prevent corrosion and other damage to the bore, the hydraulic chamber housing is constructed from expensive stainless steel alloys or other expensive corrosion resistant alloys, thus rendering the hydraulic chamber housing the most expensive component of the conventional subsurface safety valve. If the bore is damaged during, for example, manufacture, assembly, testing or actual operation, the entire hydraulic chamber housing must be replaced.

SUMMARY

In general, the present disclosure provides a technique for prolonging the useful life of a valve, e.g. a subsurface safety valve, without requiring replacement of the entire hydraulic chamber housing. A removable piston tube is provided and may be inserted into a valve housing of the valve. The removable piston tube is removably secured within a piston passage in the valve housing via a fastening mechanism. If necessary, the removable piston tube can simply be removed and replaced without requiring replacement of the overall housing.

BRIEF DESCRIPTION OF THE DRAWINGS

Certain embodiments of the valve will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a technique for prolonging the useful life of a valve, e.g. a subsurface safety valve, in an economical manner. The design of the valve enables use of the valve in harsh, corrosive environments while limiting the potential for damaging expensive valve housings. For example, a removable piston tube may be inserted into a valve housing of a subsurface safety valve to provide a pathway along which a piston may be actuated. If the removable piston tube becomes corroded or otherwise damaged, the relatively inexpensive piston tube may be replaced instead of the entire hydraulic chamber valve housing. In some embodiments, the piston tube is removably secured within a piston passage in the valve housing via a fastening mechanism. The fastening mechanism also may be used to provide a direct coupling with a hydraulic control line to completely eliminate exposure of the hydraulic chamber housing to the hydraulic fluid. If necessary, the removable piston tube can simply be removed and replaced without requiring replacement of the surrounding housing.

Although the removable piston tube is useful in many types of valves employed in downhole environments, the valve system with removable piston tube also may be employed in other types of applications and environments. In one embodiment, the valve comprises a subsurface safety valve, and the removable piston tube extends from a location inside the safety valve all the way to an exterior surface of the safety valve. This allows an external hydraulic control line to be coupled directly with the removable piston tube. By forming this direct connection, the problem of corrosion is substantially reduced or eliminated because the hydraulic fluid within the hydraulic control line only contacts the inside of the piston tube. The piston tube may be formed from a corrosion resistant material, such as a stainless steel alloy, to reduce or eliminate internal corrosion and to thus facilitate movement of the actuation piston during actuation of the safety valve.

Figure 1:
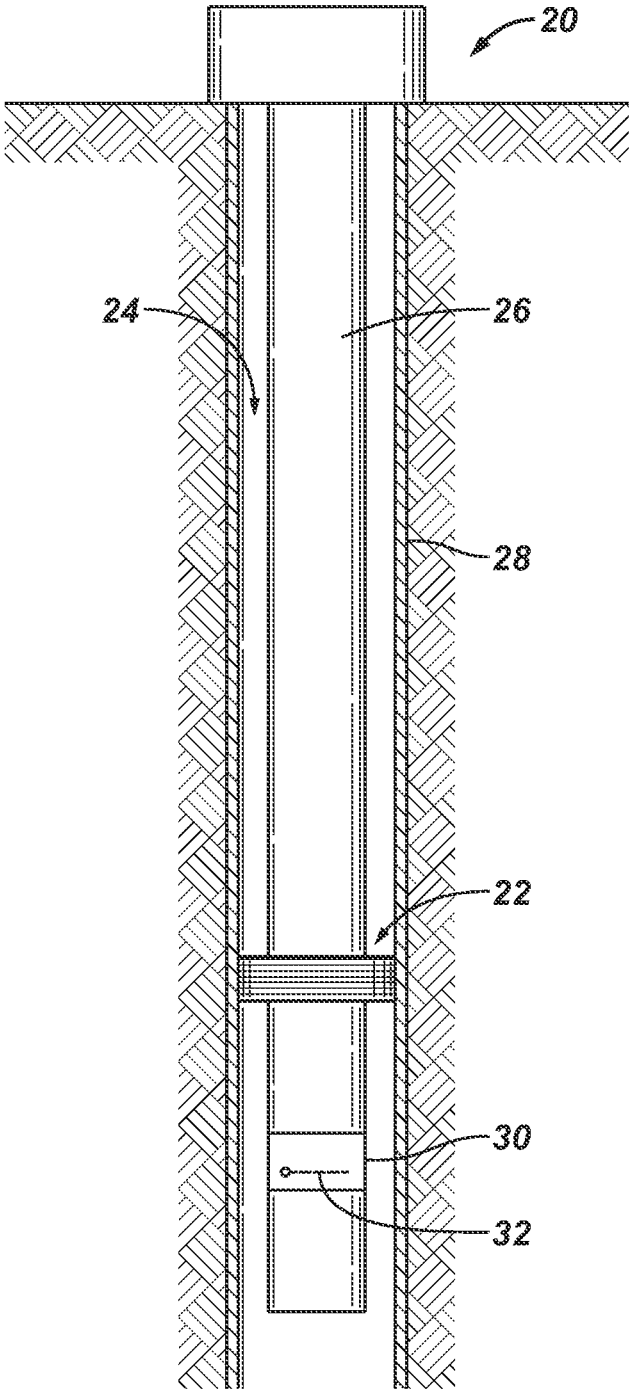
FIG. 1 is a schematic illustration of an example of a well system comprising a valve deployed in a downhole, well application, according to an embodiment of the disclosure.

Referring generally to FIG. 1, an example of one type of application utilizing a valve with removable piston tube is illustrated. The example is provided to facilitate explanation, and it should be understood that the valve system may be used in a variety of other environments and applications, including non-well related applications. In FIG. 1, an embodiment of a well system 20 is illustrated as comprising downhole equipment 22, e.g. a well completion, deployed in a wellbore 24 via a conveyance 26, e.g. production tubing or coiled tubing. Downhole equipment 22 may include a wide variety of components, depending in part on the specific application, geological characteristics, and well type. In the example illustrated, the wellbore 24 is substantially vertical and lined with a casing 28. However, various well completions and other embodiments of downhole equipment 22 may be used in a well system having many types of wellbores, including deviated, e.g. horizontal, single bore, multilateral, single zone, multi-zone, cased, uncased (open bore), or other types of wellbores.

In the example illustrated, downhole equipment 22 comprises a downhole tool 30, such as a subsurface safety valve, which may be actuated between different operational positions, e.g. positions blocking flow or allowing flow along the interior of downhole equipment 22. The safety valve 30 comprises an actuatable valve element 32, such as a flapper. If the valve element 32 is in the form of a flapper, the flapper may be transitioned between the positions allowing flow and blocking flow by a flow tube selectively actuated by a piston movable through a piston tube in the valve housing, as discussed in greater detail below.

Figure 2:
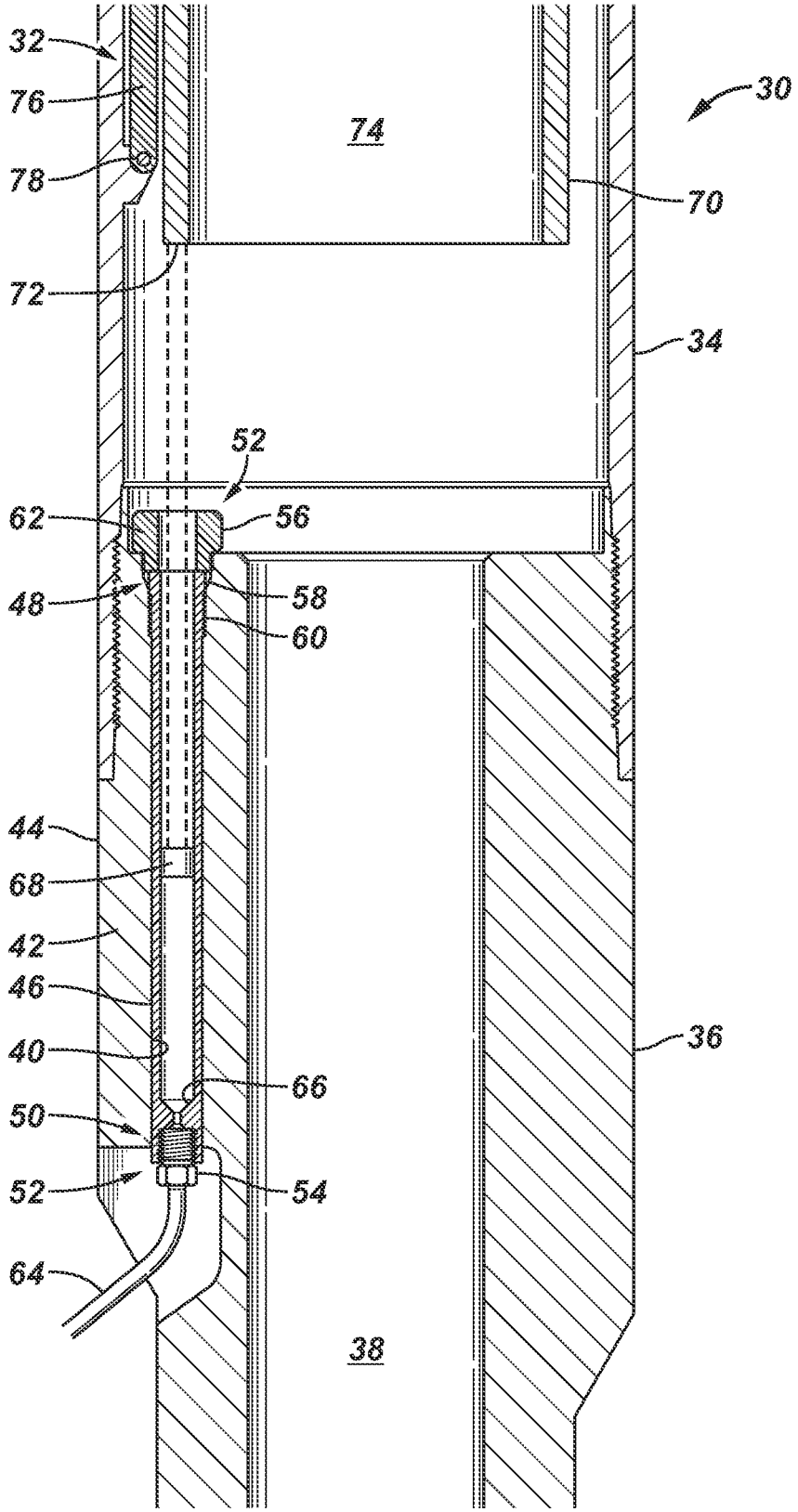
FIG. 2 is an illustration of an example of the valve, e.g. a subsurface safety valve, having a replaceable piston tube, according to an embodiment of the disclosure.

Referring generally to FIG. 2, a schematic example of one type of valve 30 is illustrated. This embodiment of the valve 30 may be used in downhole applications as, for example, a subsurface safety valve. As illustrated, the valve 30 comprises a valve housing 34 which includes a housing portion serving as a hydraulic chamber housing 36. The valve housing 34 comprises a main flow passage 38 which can be used to conduct a flow of well fluid or other fluids through downhole equipment 22. Additionally, valve housing 34 comprises a piston passage 40 located in a wall 42 of the valve housing between the main flow passage 38 and an exterior surface 44 of valve housing 34.

In this embodiment, valve 30 further comprises a piston tube 46 located in the piston passage 40. The piston tube 46 may be designed as a removable tube formed of a corrosion resistant material, such as a stainless steel or other suitable material. In some applications, the piston tube 46 extends along the length of the piston passage 40 between an internal end 48 and an external end 50 of the piston passage 40. The piston tube 46 may be removably secured within piston passage 40 by a fastening mechanism 52.

By way of example, fastening mechanism 52 may comprise an external fitting 54 positioned to couple the piston tube 46 to the valve housing 34 at external end 50 of the piston passage 40 adjacent the exterior surface 44 of the valve housing 34. In some embodiments, fastening mechanism 52 also may comprise an internal fitting 56 positioned to couple the piston tube 46 to the valve housing 34 at internal end 48 of the piston passage 40. In this particular example, piston passage 40 is located within the hydraulic chamber housing 36 of overall valve housing 34 and fittings 54, 56 are secured to the hydraulic chamber housing 36. Depending on the specific application, either or both fittings 54, 56 may be used to secure the piston tube 46; or other types of fastening mechanisms 52 may be used to removably secure the piston tube.

For example, one or both of the fittings 54, 56 may comprise a ferrule 58 which seals the corresponding end of the piston tube 46 to the surrounding valve housing 34. In some embodiments, ferrules 58 are employed at both the internal end 48 and the external end 50 to ensure the entire piston tube 46 is sealed against influx of undesirable fluids. The fastening mechanism 52 also may comprise a coupling region 60, e.g. a threaded engagement region or other suitable engagement feature, as further illustrated in FIG. 2. As illustrated, the internal end of the piston tube 46 engages valve housing 34 via a coupling region 61. The corresponding ferrule 58, e.g. a metal ferrule, seals the piston tube 46 to the valve housing 34 with the aid of a nut 62. The sealed engagement with valve housing 34 prevents annulus fluid and pressure from migrating into the piston passage 40 and also prevents mixing of production fluids/bore pressure with respect to the annulus/hydraulics. At the opposite end of piston tube 46, a hydraulic control line 64 is connected directly to the piston tube 46 via external fitting 54.

The design of piston tube 46 may vary from one application to another depending on the design parameters of the valve 30. For example, the piston tube 46 may comprise a piston stop 66 positioned to limit translation of a piston 68 that moves along the interior of piston tube 46. In the embodiment illustrated, piston stop 66 is positioned toward external end 50/external fitting 54 and is designed to contact and form a seal/barrier with piston 68 when piston 68 is moved a maximum distance towards external end 50. Piston 68 also may comprise a seal or seals, e.g. O-ring seals, which create a sealing engagement with the inside surface of the piston tube 46 during translation.

In the example illustrated, valve 30 comprises a subsurface safety valve and piston 68 is coupled to a flow tube 70 at a coupling location 72 outside of piston passage 40. The flow tube 70 has an internal, longitudinal flow tube passage 74 which is a continuation of the main flow passage 38. As illustrated, the flow tube 70 is movably positioned within valve housing 34 to enable selective transitioning of valve element 32 between an open position and a position that allows the valve element 32 to close. By way of example, valve element 32 may comprise a flapper 76 which may be pivoted about a pivot point 78 to the open flow position illustrated in FIG. 2. It should be noted that valve 30 may be positioned in a variety of orientations depending on the specific application. In wellbore applications, for example, the valve 30 may be oriented in a generally vertical or lateral orientation depending on the configuration of the wellbore 24. In a variety of downhole applications, the orientation of valve 30 may be inverted relative to the orientation illustrated in FIG. 2 so that the external end 50 is above internal end 48 when positioned in wellbore 24.

Figure 3:
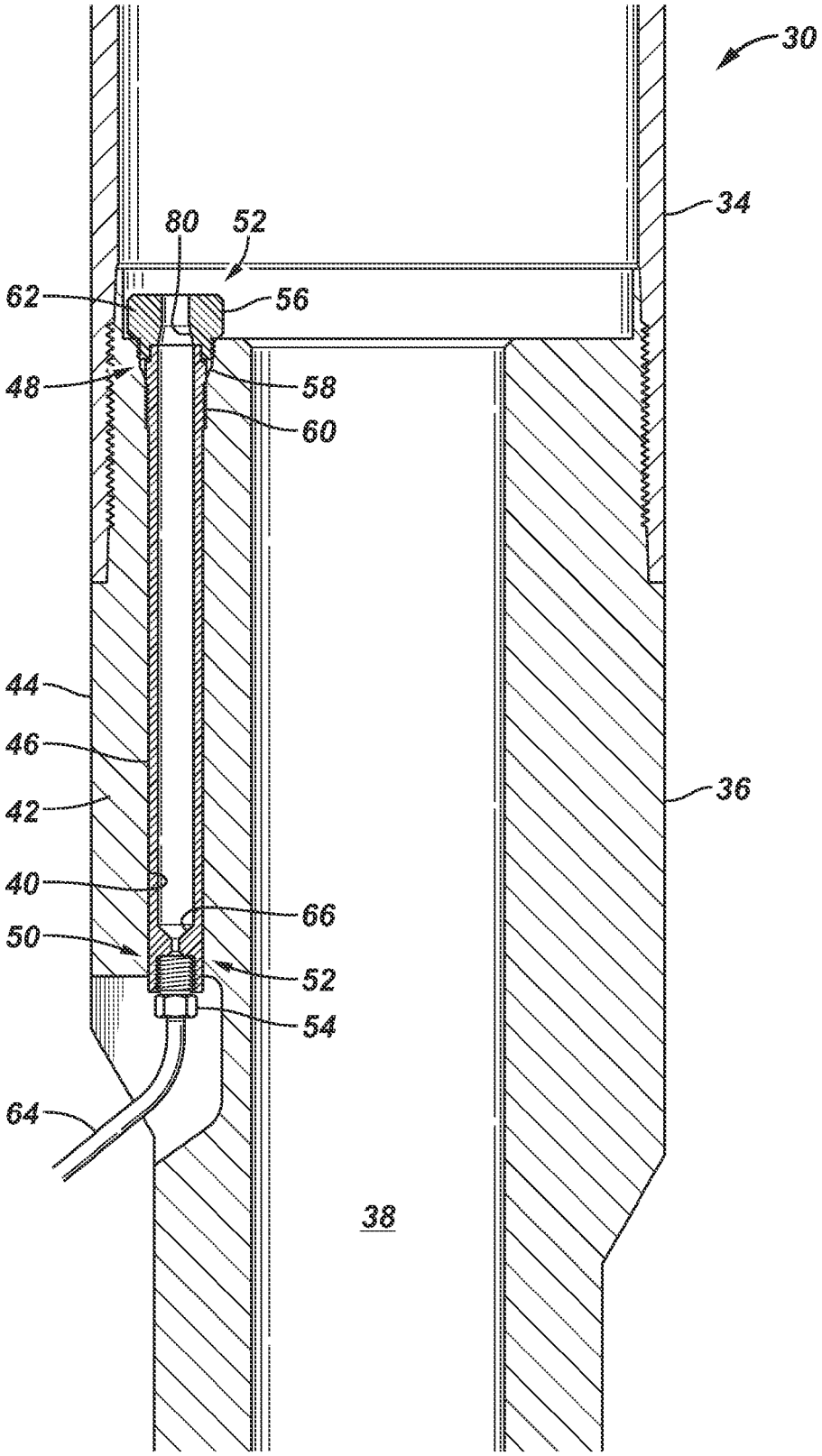
FIG. 3 is an illustration of another example of the valve, according to an alternate embodiment of the disclosure.

Referring generally to FIG. 3, another embodiment of valve 30 and piston tube 46 is illustrated. In this embodiment, an additional piston stop 80 is positioned at internal end 48 generally at an opposite end of piston tube 46 from piston stop 66. Piston stop 80 may be formed, for example, within piston tube 46 or within nut 62, as illustrated. In some embodiments, piston stop 80 is shaped to create a seal/barrier with piston 68 when piston 68 is fully translated along piston tube 46 toward internal end 48.

Figure 4:
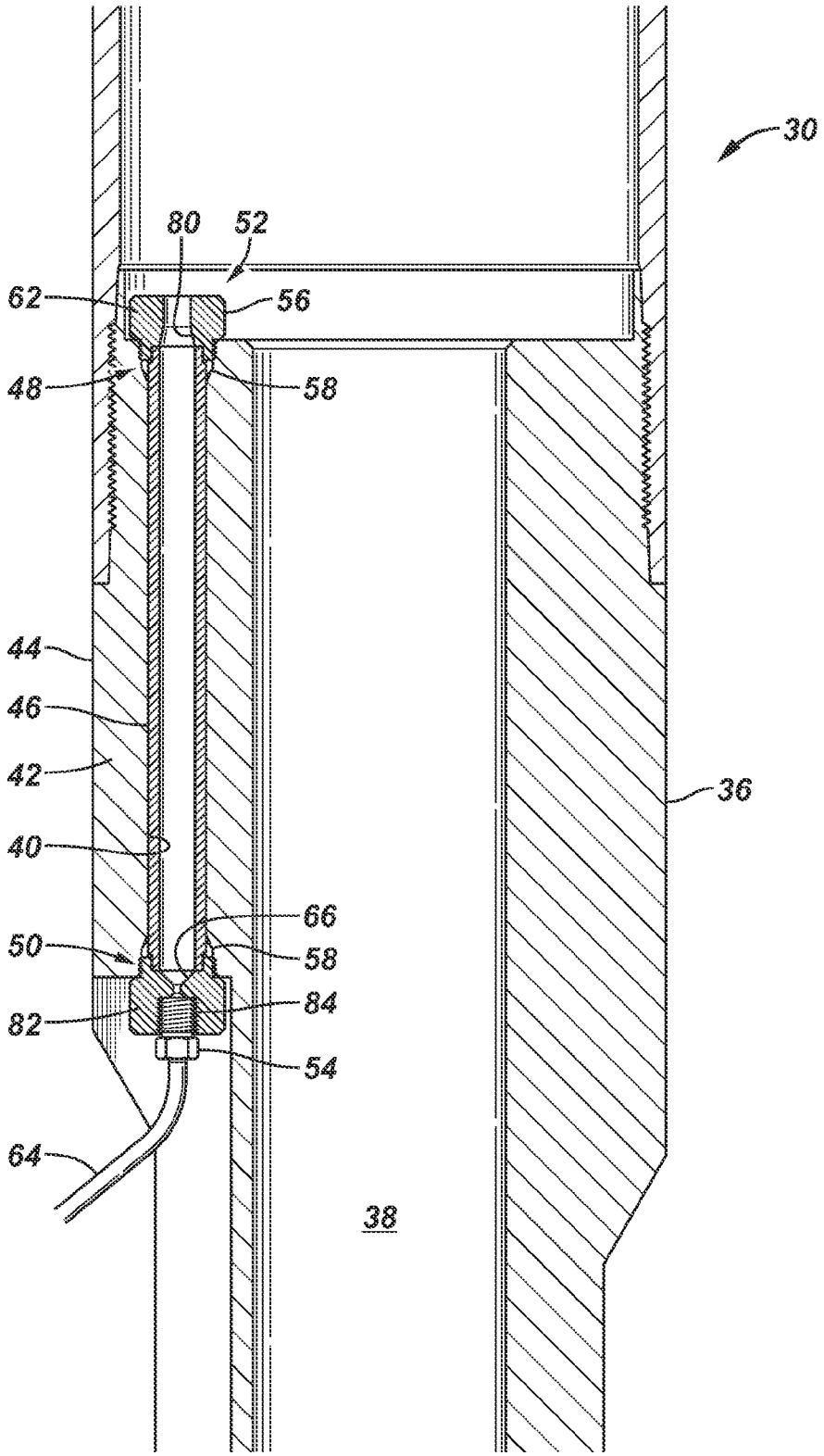
FIG. 4 is an illustration of another example of the valve, according to an alternate embodiment of the disclosure.

In another embodiment, the piston tube 46 is not coupled, e.g. threaded, into place but, instead, is contained on both ends by a ferrule and nut system as illustrated in FIG. 4. In this embodiment, an additional nut 82 is threadably engaged or otherwise coupled within piston passage 40 at external end 50 to secure the corresponding ferrule 58 against piston tube 46. The nut 82 also may comprise a hydraulic port 84 to which hydraulic control line 64 is connected. In the specific example illustrated in FIG. 4, both the piston stop 66 and the opposed piston stop 80 are used to form seals/barriers with piston 68. This embodiment allows the piston tube 46 to be constructed of a uniform wall thickness which enables easy manufacture by, for example, extrusion.

Figure 5:
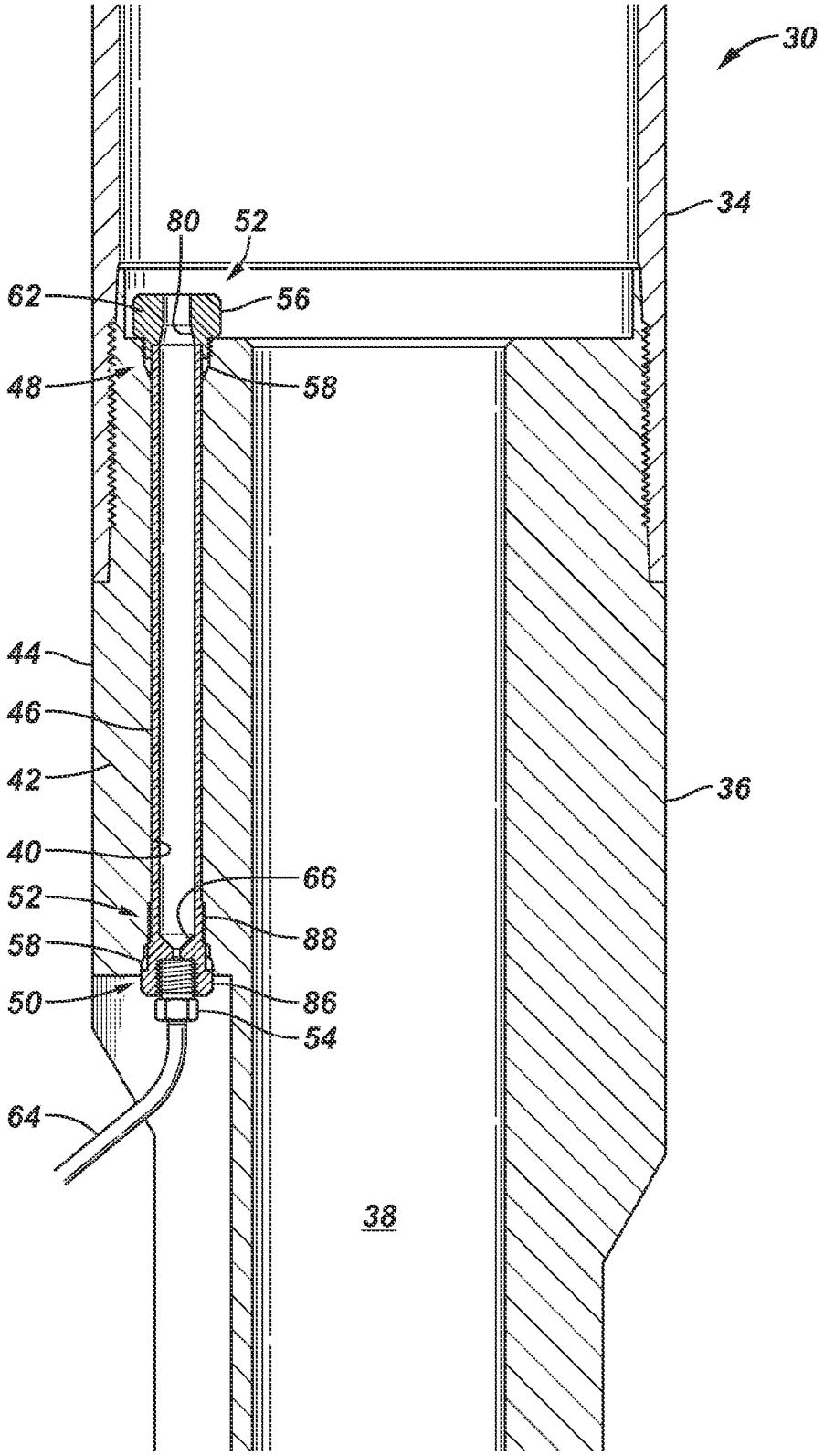
FIG. 5 is an illustration of another example of the valve, according to an alternate embodiment of the disclosure.
Figure 6:
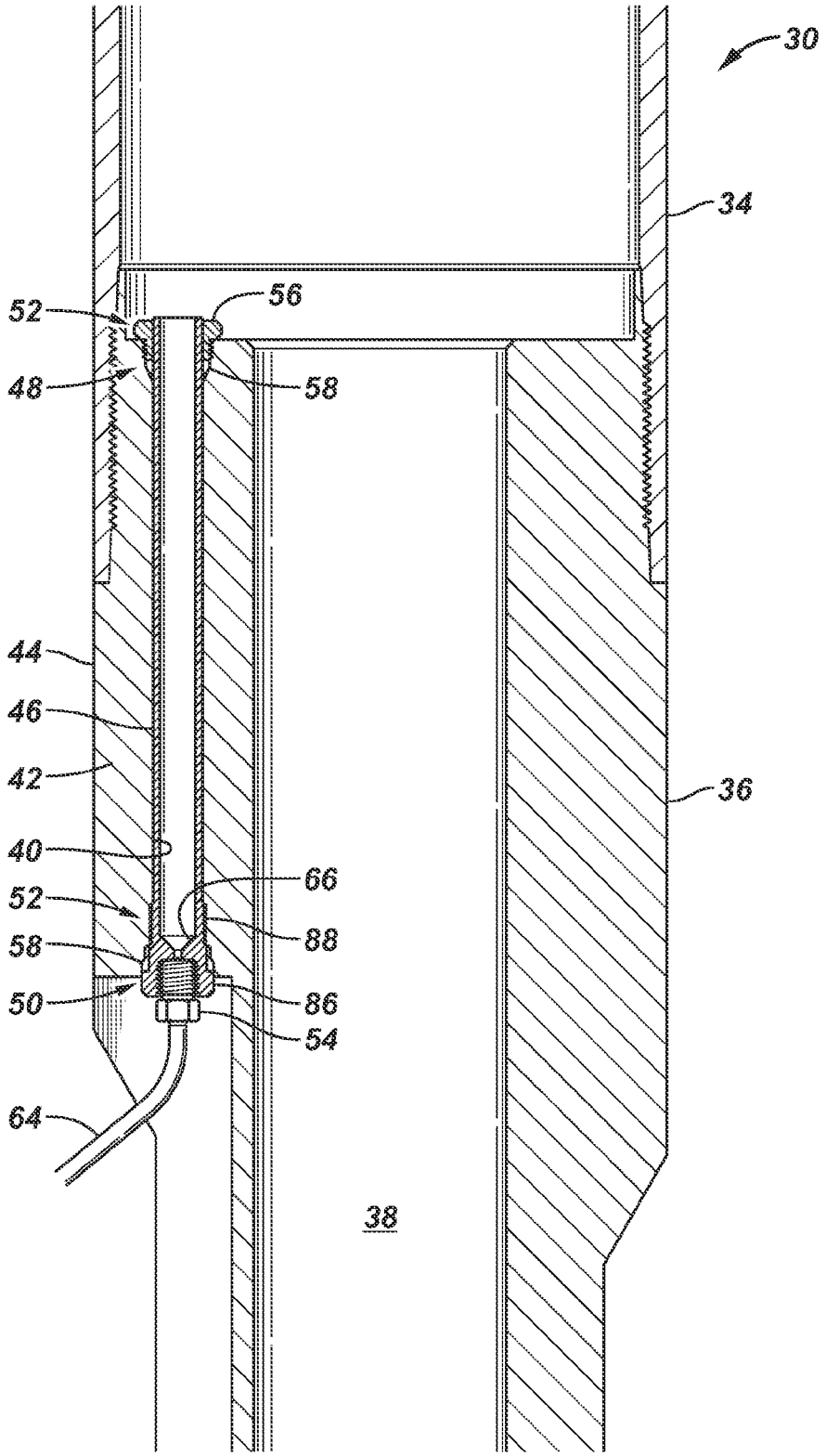
FIG. 6 is an illustration of another example of the valve, according to an alternate embodiment of the disclosure.

In the embodiment illustrated in FIG. 5, the piston tube 46 comprises an external end 86 which engages the surrounding wall of piston passage 40 via engagement region 88. Engagement region 88 may be a threaded engagement end or it may comprise other types of coupling features. The piston tube 46 is coupled into place from the external end 50, and ferrule 58 may be utilized to create a seal between the piston tube 46 and the surrounding internal surface of wall 42. The hydraulic line 64 may be connected directly to the piston tube 46 via a suitable fitting, such as external fitting 54. In the specific example illustrated, nut 62 is employed at an opposite end of piston tube 46 from external end 86. At least one piston stop (e.g. two piston stops comprising piston stop 66 and piston stop 80) may be utilized to limit the translational movement of piston 68. In other applications, however, the internal piston stop 80 may be omitted, as illustrated in the embodiment of FIG. 6. Omission of at least one of the two stops 66, 80 enables installation of piston 68 after the piston tube 46 has been fully installed into the valve housing 34. Consequently, pressure integrity tests may be performed without piston 68. It should be noted that some applications may omit the piston stops in the piston tube 46 and in such embodiments the stops can be externalized.

Figure 7:
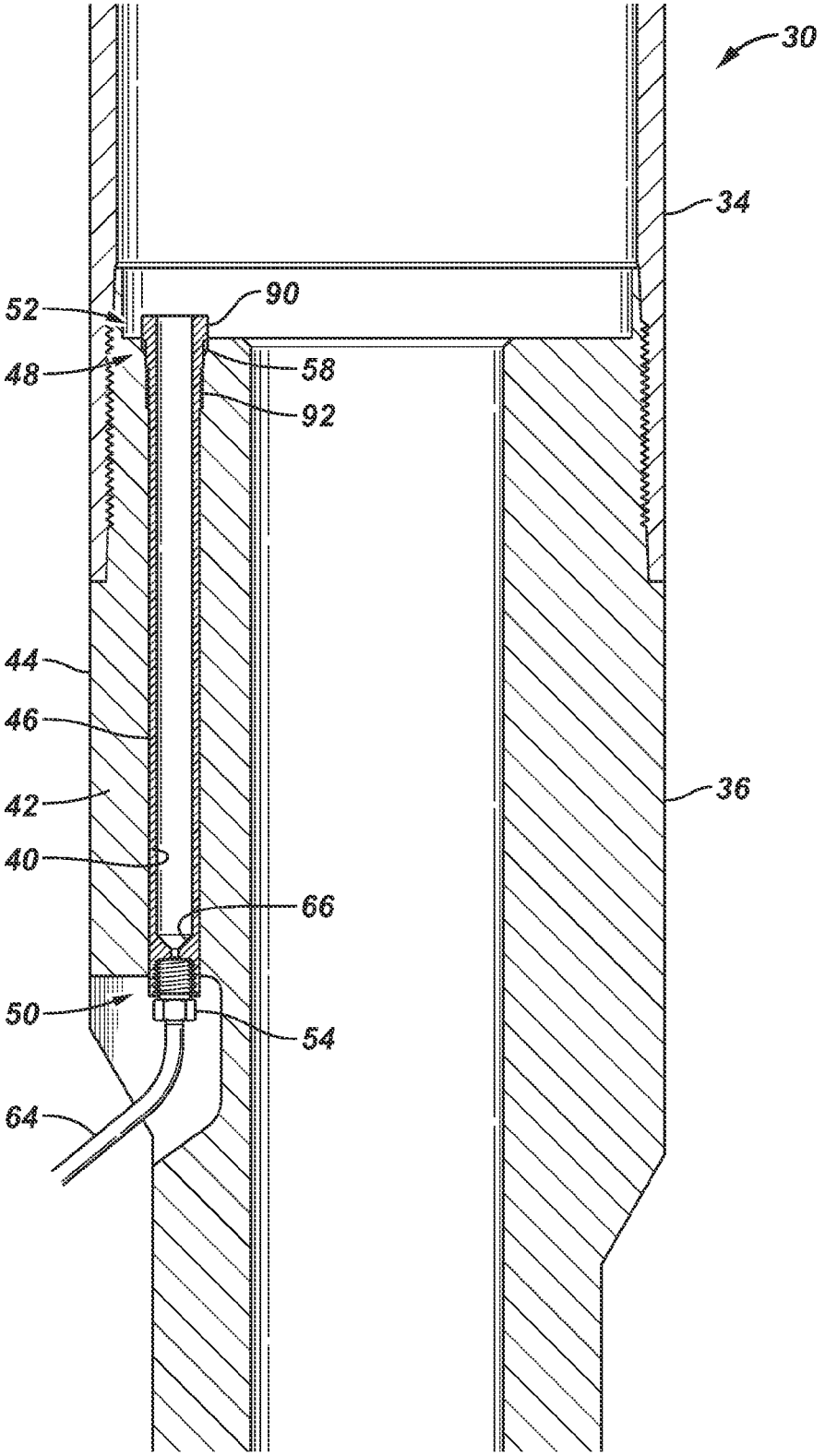
FIG. 7 is an illustration of another example of the valve, according to an alternate embodiment of the disclosure.

Referring generally to FIG. 7, another embodiment of valve 30 and piston tube 46 is illustrated. In this embodiment, the component configuration is similar to that described above with respect to the embodiment illustrated in FIG. 2. However, nut 62 has been placed with a piston shoulder 90 which serves to back up the corresponding ferrule 58. The piston shoulder 90 may have an external coupling region 92, e.g. an external threaded region, designed to engage corresponding features in the surrounding housing, e.g. corresponding threads positioned along the surface defining piston passage 40. The piston tube 46 may be moved into engagement via coupling region 92 and secured, e.g. torqued, into place to seal the ferrule to the surrounding surface of housing 34 and to the outer surface of piston tube 46.

Figure 8:
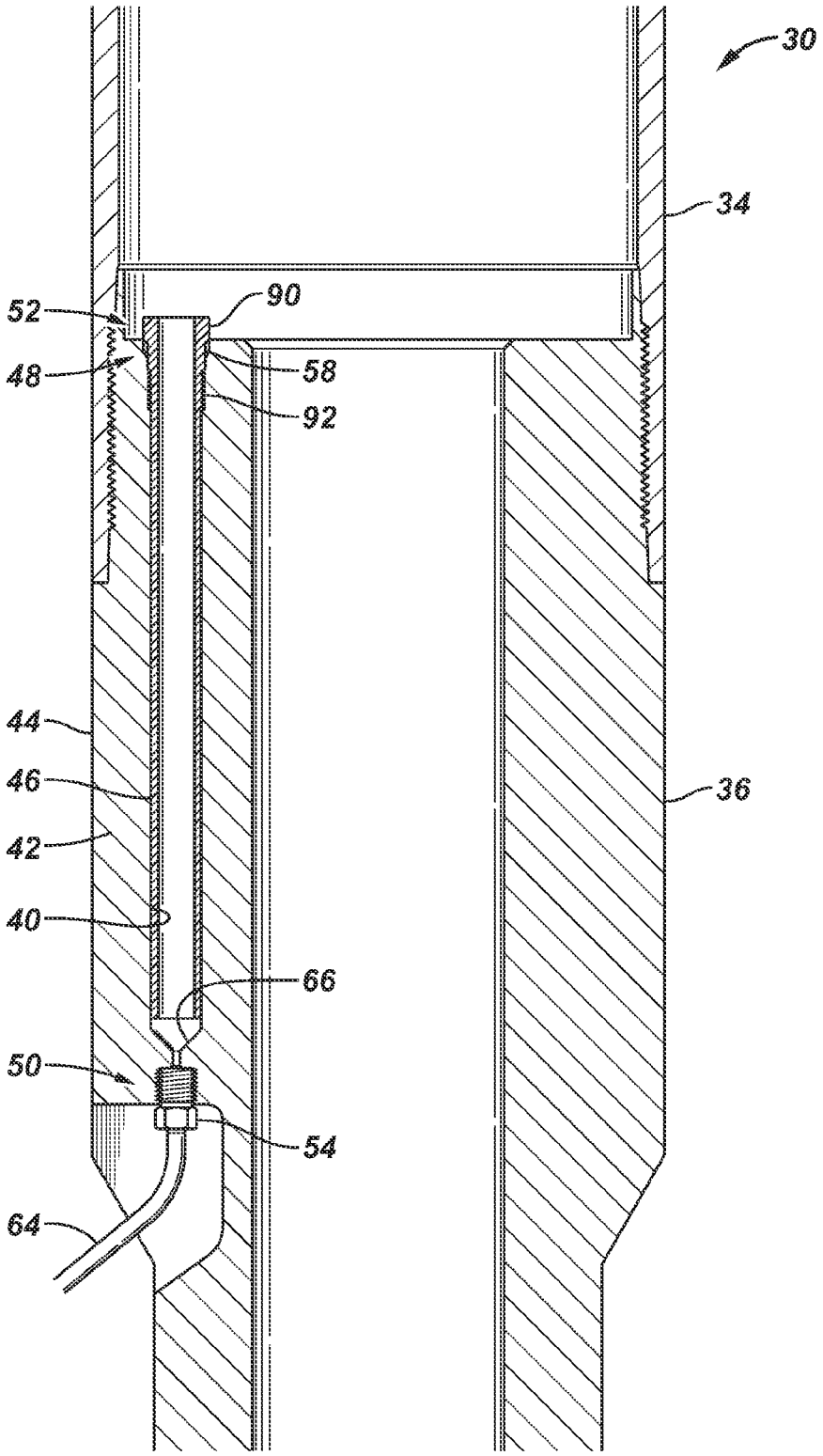
FIG. 8 is an illustration of another example of the valve, according to an alternate embodiment of the disclosure.

A similar arrangement is illustrated in FIG. 8, except piston stop 66 is not part of piston tube 46. Instead, the piston stop 66 is located generally at external end 50 and is formed directly in the valve housing 34, e.g. in hydraulic chamber housing 36. For example, the piston stop 66 may be formed in housing wall 42 between the piston tube 46 and external end 50. In this embodiment, the hydraulic line 64 connects directly to the valve housing 34 via a suitable fitting, such as external fitting 54.

Figure 9:
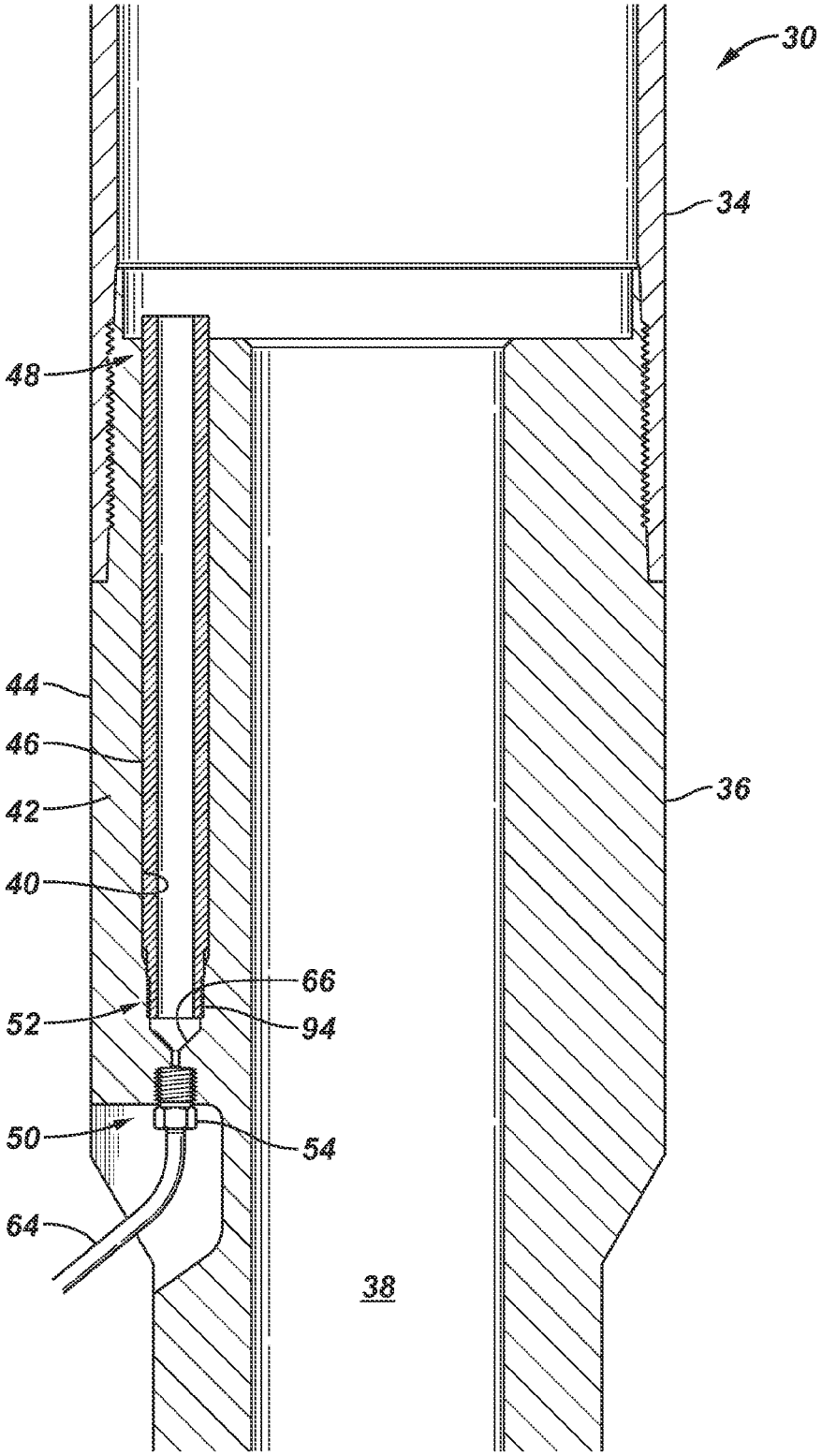
FIG. 9 is an illustration of another example of the valve, according to an alternate embodiment of the disclosure.

Referring generally to FIG. 9, another embodiment of valve 30 and piston tube 46 is illustrated. In this embodiment, the component configuration is similar to that described above with respect to the embodiment illustrated in FIG. 8. However, the coupling region 92 has been removed from piston tube 46 and a coupling region 94, e.g. a threaded coupling region, has been added at a generally opposite end of piston tube 46. As illustrated, coupling region 94 may be positioned along piston tube 46 at an end of the piston tube 46 generally proximate external end 50. In this specific example, piston stop 66 is formed directly in housing wall 42 and piston tube 46 is secured within piston passage 40 adjacent the piston stop 66 via coupling region 94. Coupling region 94 is designed to engage corresponding features, e.g. threads, which may be formed along the internal surface that defines piston passage 40. In some embodiments, at least one ferrule 58 may be employed to form a seal between the piston tube 46 and the surrounding valve housing.

The specific configuration of removable piston tube 46 may vary depending on the parameters of a given application. Additionally, piston tube 46 may be formed from a variety of corrosion resistant materials, including stainless steels, other metal alloys, non-metal materials, composite materials and other materials suitable for a given application and environment. Also, the fastening systems, seal systems, piston assemblies, and other components of the valve may vary depending on the specific application and/or environment. The orientation of the components and of the overall valve 30 also may change depending on the requirements of a specific operation.

The use of an independent, removable piston tube may be implemented in multiple ways. As described above, a fitting may be employed to couple the piston tube to the valve housing on the outside or on the inside. Additionally, multiple fittings, e.g. two fittings, may be used to couple the piston tube both internally and externally. The hydraulic control line may be combined with an external fitting to the housing, or the control line may be coupled directly to the removable piston tube. Various combinations of these approaches also may be employed. The fittings can be metal-to-metal type seals, o-ring seals, t-seals, welded fittings, or other suitable fittings or fastening mechanisms.

Additionally, various fittings, adapters or other structures may be employed at one, none, or both ends of the piston tube to create piston stops if desired. The piston stops may comprise metal, plastic, and/or elastomer sealing faces adapted to the design of the piston to create a secondary barrier for wellbore fluids migrating up the control line. In addition to creating piston stops, the adapters (e.g. coupling end 86 or nut 82) may be designed to provide a more geometrically friendly shape for connection of the hydraulic control line. The geometrically friendly shape facilitates, for example, attachment of the hydraulic control line to the piston tube and/or attachment of the piston tube to the surrounding housing. Various adapters/fittings also can be designed with a relatively small footprint to facilitate use of the valve system in environments with limited space available. The couplings may be threaded couplings or various other types of couplings, e.g. interlocking features, interference fits, or other couplings suitable for a given operation.

Although only a few embodiments of the subsurface valve system have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling flow along a well completion, comprising:

a downhole tool having a housing with a main flow passage and a piston passage located in a housing wall between the main flow passage and an exterior surface of the housing, the downhole tool further comprising:

a piston tube located in the piston passage and extending along the length of the piston passage;

an internal fitting to couple the piston tube to the housing at an internal end of the piston passage; and an external fitting positioned to couple the piston tube to the housing and to a hydraulic control line, the external fitting being located at an external end of the piston passage adjacent the exterior surface of the housing, the piston tube being selectively removable from the piston passage and comprising a material which is corrosion resistant.

2. The system as recited in claim 1, wherein the downhole tool further comprises a piston slidably positioned within the piston tube.

3. The system as recited in claim 2, wherein the downhole tool further comprises a flow tube coupled to the piston at a location outside of the piston passage.

4. The system as recited in claim 3, wherein the downhole tool further comprises a flapper positioned for interaction with the flow tube to enable control over movement of the flapper between a closed position and an open position.

5. The system as recited in claim 1, further comprising a hydraulic line coupled directly to the piston tube at the external fitting.

6. The system as recited in claim 1, wherein the piston tube comprises a piston stop proximate the external fitting.

7. The system as recited in claim 1, wherein the piston tube is sealed to the housing with a ferrule.

8. The system as recited in claim 1, wherein the piston tube is sealed to the housing with a first ferrule at the internal end and a second ferrule at the external end.

9. The system as recited in claim 1, wherein the piston tube is threaded into the housing.

10. The system as recited in claim 1, wherein the piston tube comprises a shoulder that works in cooperation with a ferrule to form a seal between the piston tube and the housing.

* * * * *